US005195324A

United States Patent [19]

Cheung

[11] Patent Number: 5,195,324

[45] Date of Patent: Mar. 23, 1993

[54] CRYOGENIC RECTIFICATION SYSTEM FOR PRODUCING NITROGEN AND ULTRA HIGH PURITY OXYGEN

[75] Inventor: Harry Cheung, Williamsville, N.Y.

[73] Assignee: Prazair Technology, Inc., Danbury, Conn.

[21] Appl. No.: 854,094

[22] Filed: Mar. 19, 1992

[51] Int. Cl.[5] ..... F25J 3/02

[52] U.S. Cl. ..... 62/24; 62/22

[58] Field of Search ..... 62/23, 24, 22, 28, 32, 62/36

[56] References Cited

U.S. PATENT DOCUMENTS

| | | | |
|---|---|---|---|
| 4,560,397 | 12/1985 | Cheung | 62/28 |
| 4,594,085 | 6/1986 | Cheung | 62/25 |
| 4,604,117 | 8/1986 | Cheung | 62/25 |
| 4,755,202 | 7/1988 | Cheung | 62/17 |
| 4,780,118 | 10/1988 | Cheung | 62/11 |
| 4,783,321 | 11/1988 | Ayres et al. | 62/24 |
| 4,824,453 | 4/1989 | Rottman et al. | 62/24 |
| 4,895,583 | 1/1990 | Flanagan et al. | 62/24 |
| 4,902,321 | 2/1990 | Cheung | 62/24 |
| 4,957,523 | 9/1990 | Zarate | 62/24 |
| 5,074,898 | 12/1991 | Cheung | 62/38 |

OTHER PUBLICATIONS

Cryogenic Processes And Equipment, Ayres, eta al. ASME, Dec. 9, 1984, pp. 155-163.

*Primary Examiner*—Ronald C. Capossela
*Attorney, Agent, or Firm*—Stanley Ktorides

[57] ABSTRACT

A cryogenic rectification system wherein bottoms from a single column nitrogen production system are used to produce ultra high purity oxygen in a two column purification system, and bottoms from the first purification column are employed to drive the nitrogen column top condenser to generate additional nitrogen column reflux.

10 Claims, 4 Drawing Sheets

CRYOGENIC RECTIFICATION SYSTEM FOR PRODUCING NITROGEN AND ULTRA HIGH PURITY OXYGEN

TECHNICAL FIELD

This invention relates generally to the cryogenic rectification of feed air and, more particularly, to the production of ultra high purity oxygen.

BACKGROUND ART

In recent years there has developed an increased demand for ultra high purity oxygen for use, for example, in the electronics industry for the production of semiconductors and microchips.

Oxygen having a high purity of about 99.5 percent has long been produced by the cryogenic rectification of air in a double column cryogenic rectification plant. Heretofore, this conventional oxygen product has been used for production of ultra high purity oxygen by upgrading to a purity of 99.99 percent or more.

In some instances only a small amount of ultra high purity oxygen is required without the need for conventional high purity oxygen. In these situations, a conventional double column system would produce excessive amounts of oxygen and thus be wasteful. Furthermore, nitrogen product may be required at an elevated pressure. Since the conventional double column system produces nitrogen at a low pressure, further compression of the nitrogen product would be required further adding to the inefficiency of the conventional double column cycle for such situations.

It is known that nitrogen, including elevated pressure nitrogen, may be produced by the cryogenic rectification of air employing a single column system. It would be desirable to have a single column system which can efficiently produce nitrogen, including elevated pressure nitrogen, by the cryogenic rectification of air, which can be readily integrated with a system for producing ultra high purity oxygen without harming the efficiency of the single column nitrogen production system.

Accordingly, it is an object of this invention to provide a cryogenic rectification system for producing nitrogen and ultra high purity oxygen wherein the nitrogen product is produced in a single column system.

SUMMARY OF THE INVENTION

The above and other objects, which will become apparent to one skilled in the art upon a reading of this disclosure, are attained by the present invention, one aspect of which is:

A method for producing nitrogen and ultra high purity oxygen by cryogenic rectification of feed air comprising:

(A) introducing feed air into a single column system comprising a column and a top condenser and separating the feed air in the single column system by cryogenic rectification into nitrogen-rich vapor and oxygen-enriched liquid having an oxygen concentration not exceeding 80 percent and containing heavier and lighter components;

(B) recovering a first portion of the nitrogen-rich vapor from the column of the single column system as product nitrogen, condensing a second portion of the nitrogen-rich vapor in the top condenser, and employing resulting nitrogen-rich liquid as reflux for said column;

(C) passing oxygen-enriched liquid from the single column system into and down a first purifying column having a bottom reboiler to produce an oxygen-richer fluid in the lower portion of the first purifying column substantially free of lighter components;

(D) passing oxygen-richer liquid from the bottom reboiler of the first purifying column into the top condenser of the single column system to condense by indirect heat exchange nitrogen-rich vapor;

(E) passing oxygen-richer vapor from a point at least one equilibrium stage above the bottom reboiler of the first purifying column into and up a second purifying column to produce ultra high purity oxygen in the upper portion of the second purifying column substantially free of heavier components; and (F) recovering ultra high purity oxygen from the second purifying column.

Another aspect of this invention is:

An apparatus for producing nitrogen and ultra high purity oxygen by cryogenic rectification comprising:

(A) a single column system comprising a column and a top condenser, means for introducing feed into the column, means for passing fluid from the column to the top condenser and from the top condenser to the column, and means for recovering product from the column;

(B) a first purifying column having a bottom reboiler, means for passing fluid from the single column system into the upper portion of the first purifying column, and means for passing fluid from the bottom reboiler of the first purifying column into the top condenser;

(C) a second purifying column, means for passing fluid from a point at least one equilibrium stage above the bottom reboiler of the first purifying column into the second purifying column; and (D) means for recovering product from the second purifying column.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et. al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile components(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150° K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "top condenser" means a heat exchange device which generates column downflow liquid from column top vapor.

As used herein, the term "bottom reboiler" means a heat exchange device which generates column upflow vapor from column bottom liquid. A bottom reboiler may be physically within or outside a column. When the bottom reboiler is within a column, the bottom reboiler encompasses the portion of the column below the lowermost tray or equilibrium stage of the column.

As used herein, the term "lighter component" means a species having a higher volatility than oxygen.

As used herein, the term "heavier component" means a species having a lower volatility than oxygen.

As used herein, the term "substantially free" means having no more than 0.01 ppm of a component or components other than argon, and no more than about 20 ppm of argon.

DETAILED DESCRIPTION

The invention may be practiced with any suitable single column nitrogen production system and will be discussed in greater detail with three such systems, the waste expansion cycle, the air expansion cycle, and the hybrid cycle.

Figure 1:
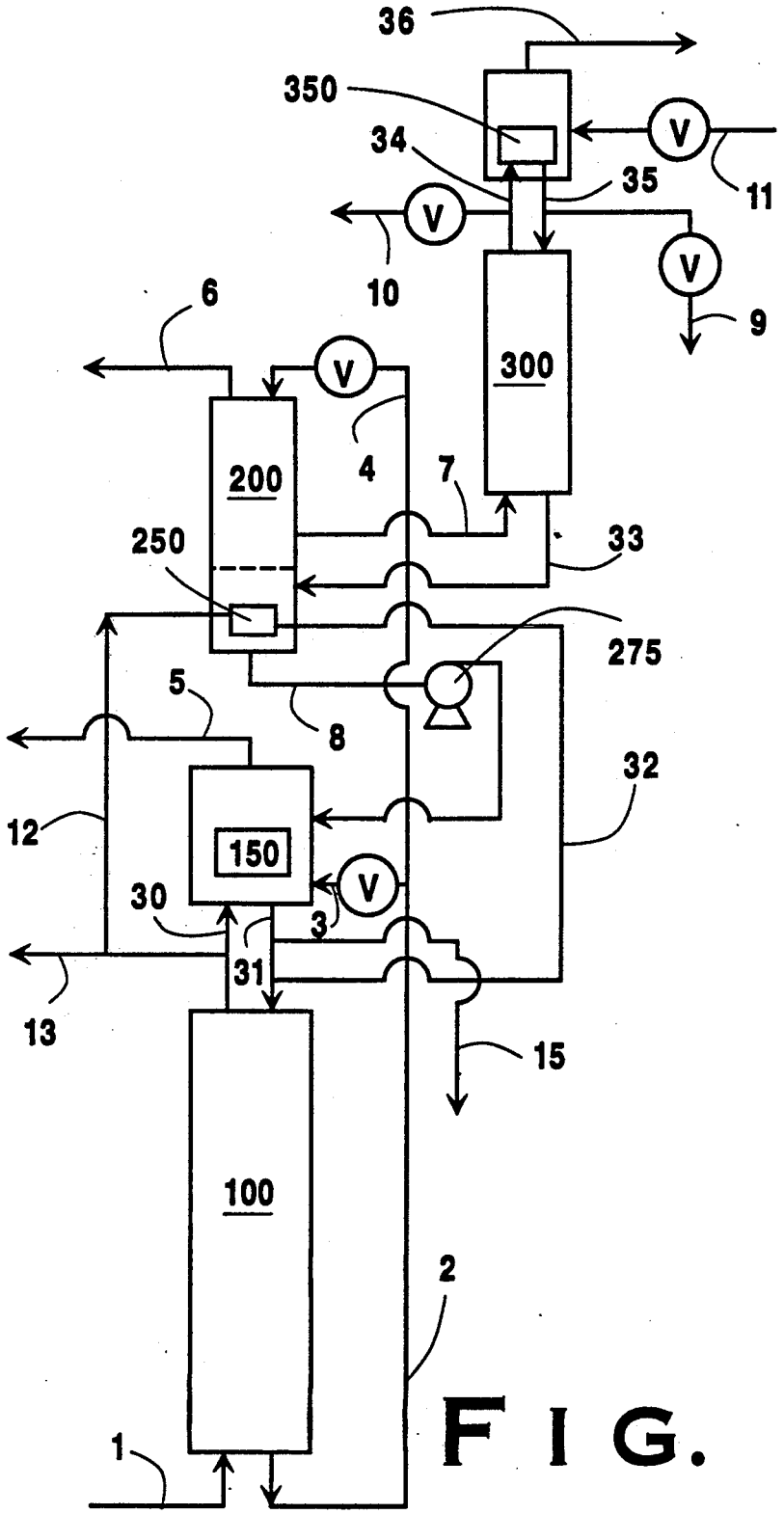
FIG. 1 is a schematic representation of one embodiment of the invention particularly applicable to a waste expansion nitrogen production cycle.

FIG. 1 illustrates the invention as it might be integrated with a waste expansion cycle wherein a high pressure waste stream is expanded to generate refrigeration to drive the cryogenic rectification. Referring now to FIG. 1, feed air 1 is introduced into nitrogen column 100 which with top condenser 150 comprises a single column nitrogen production system. Column 100 is operating at a pressure within the range of from 70 to 170 pounds per square inch absolute (psia). Within column 100 the feed air is separated by cryogenic rectification into nitrogen-rich vapor and oxygen-enriched liquid. Nitrogen-rich vapor portion 30 is passed into top condenser 150 wherein it is condensed by indirect heat exchange and returned to column 100 as reflux stream 31. A portion 13 of the nitrogen-rich vapor is recovered from column 100 as product nitrogen having a nitrogen purity of at least 99.99 percent. If desired, a portion 15 of the condensed nitrogen-rich liquid may be recovered as product nitrogen which may be in addition to or in place of portion 13. When the liquid nitrogen is the only nitrogen product produced, it is the recited first portion of the nitrogen-rich vapor recovered from the column.

Oxygen-enriched liquid is withdrawn from the lower portion of column 100 as stream 2. The oxygen-enriched liquid has an oxygen concentration not exceeding 42 percent and generally within the range of from 35 to 40 percent, and also contains lighter components such as nitrogen and argon, and heavier components such as krypton, xenon and hydrocarbons. A portion 3 of stream 2 is passed into top condenser 150 wherein it serves to condense the nitrogen-rich vapor as was earlier described. Another portion 4 of stream 2, generally comprising from 10 to 30 percent of stream 2, is passed into the upper portion of first purifying column 200 which is operating at a pressure within the range of from 15 to 45 psia.

Oxygen-enriched liquid flows down column 200 and, in so doing, lighter components are stripped out of the downflowing liquid by upflowing vapor which is generated by bottom reboiler 250 of first purifying column 200. The resulting oxygen-richer fluid, having an oxygen concentration of at least 99.99 percent and being substantially free of lighter components, collects in the lower portion of column 200. Some of this oxygen-richer fluid is boiled by bottom reboiler 250 to produce the upflowing vapor for the aforedescribed stripping action. Reboiler 250 is driven by high pressure nitrogen-rich vapor which is passed into bottom reboiler 250 as stream 12. Resulting condensed nitrogen-rich liquid is passed from bottom reboiler 250 as stream 32 to column 100 for additional reflux. Upflowing vapor, containing essentially all of the lighter components that were in the oxygen-enriched liquid fed into column 200 except for some residual argon retained in the oxygen-richer fluid, is passed out of the upper portion of column 200 as stream 6.

Oxygen-richer liquid is passed from bottom reboiler 250 as stream 8 into top condenser 150 wherein it serves to assist in the condensation of the nitrogen-rich vapor to generate reflux for column 100. Preferably, as illustrated in FIG. 1, stream 8 is pumped to a higher pressure, such as by pump 275, prior to entering top condenser 150. In this way, additional liquid reflux is created for the operation of column 100 thus not compromising the nitrogen generating capability of the nitrogen column despite its integration with an ultra high purity oxygen production system and the use of the nitrogen column bottoms as the feed for the ultra high purity oxygen production system. Resulting vapor from the heat exchange in top condenser 150 is removed as waste stream 5. This high pressure waste stream may be expanded through a turboexpander to generate refrigeration and passed in indirect heat exchange with incoming feed air to cool the feed air and provide refrigeration into the column system to carry out the cryogenic rectification.

Oxygen-richer vapor, generated by the vaporization of oxygen-richer liquid in bottom reboiler 250, is withdrawn as stream 7 from column 200 from a point at least one equilibrium stage above bottom reboiler 250 and passed into the lower portion of second purifying column 300 which is operating at a pressure within the range of from 15 to 45 psia. The lowermost equilibrium stage of column 200 is represented as the broken line. Oxygen-richer vapor flows up column 300 and, in so doing, heavier components are washed out of the upflowing vapor by downflowing liquid resulting in the production of ultra high purity oxygen vapor. The downflowing liquid containing substantially all of the heavier components that were in feed stream 7 is then passed out of column 300 as stream 33 and into column 200 at bottom reboiler 250.

Ultra high purity oxygen vapor substantially free of heavier components and having an oxygen concentration of at least 99.995 percent collects in the upper portion of column 300. A portion 10 of the ultra high purity oxygen vapor may be recovered as product ultra high purity oxygen. Ultra high purity oxygen stream 34 is passed into top condenser 350 of column 300 wherein it is condensed by indirect heat exchange with liquid such as liquid air or liquid nitrogen provided into top condenser 350 by stream 11. Resulting ultra high purity oxygen liquid 35 is passed from top condenser 350 into column 300 as the downflowing liquid which acts to wash heavier components out of the upflowing oxygen-richer vapor as was previously described. A portion 9 of the ultra high purity oxygen liquid may be recovered as product ultra high purity oxygen. Vapor resulting from the heat exchange in top condenser 350 is passed out of the system as stream 36. The ultra high purity oxygen product produced by this invention may be properly considered a byproduct of the main nitrogen production system. As such the ultra high purity oxygen product flow will generally comprise from about 0.5 to 5 percent of the feed air flow.

Figure 2:
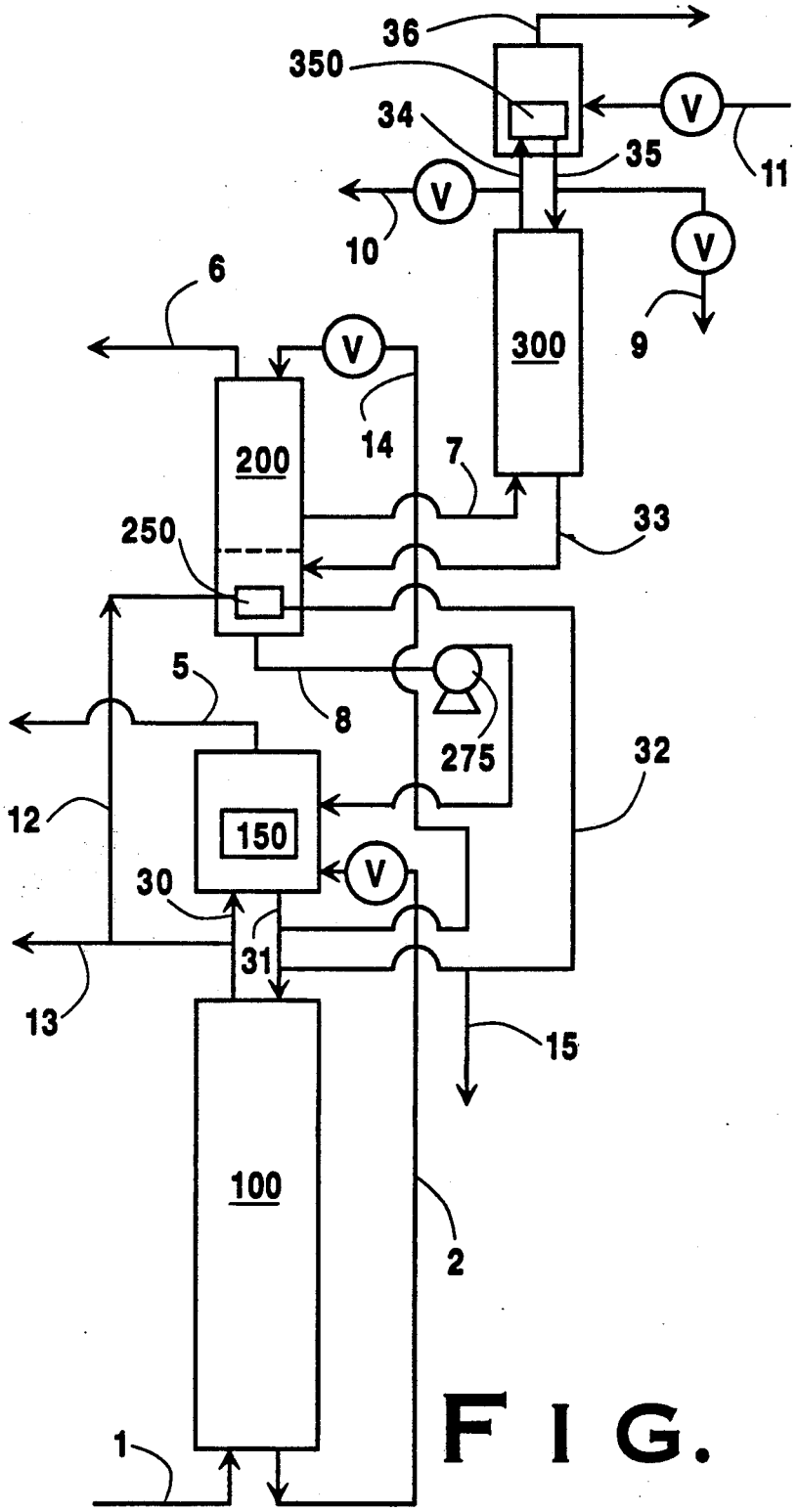
FIG. 2 is a schematic representation of an embodiment of the invention similar to that of FIG. 1 illustrating feed from the top condenser rather than from the nitrogen column into the first purifying column.

FIG. 2 illustrates a system similar to that illustrated in FIG. 1 except that the entire oxygen-enriched liquid stream 2 is passed into top condenser 150 and a stream 14 of oxygen-enriched liquid is passed from top condenser 150 into the upper portion of column 200. In this case, the oxygen-enriched liquid in stream 14 has an oxygen concentration not exceeding 67 percent, and generally has an oxygen concentration within the range of from 48 to 62 percent. In the embodiment illustrated in FIG. 2, liquid nitrogen product stream 15, if employed, is taken from stream 32 although it may be taken from stream 31 as in the embodiment illustrated in FIG. 1. All other elements of the embodiment illustrated in FIG. 2 are essentially the same as those of the embodiment illustrated in FIG. 1 and will not be again described in detail. The numerals in FIG. 2 correspond to those of FIG. 1 for the common elements.

Figure 3:
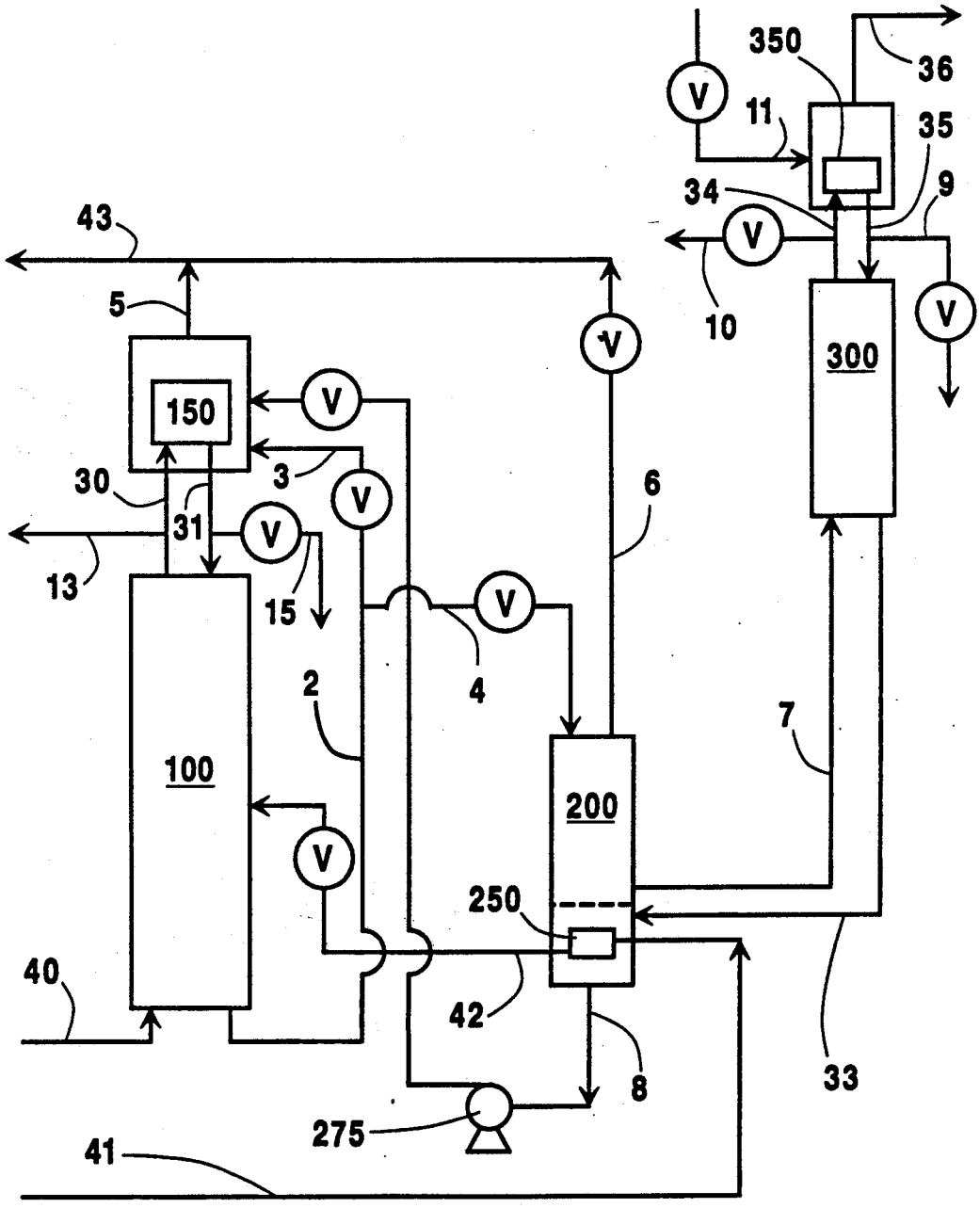
FIG. 3 is a schematic representation of an embodiment of the invention particularly applicable to an air expansion nitrogen production cycle.
Figure 4:
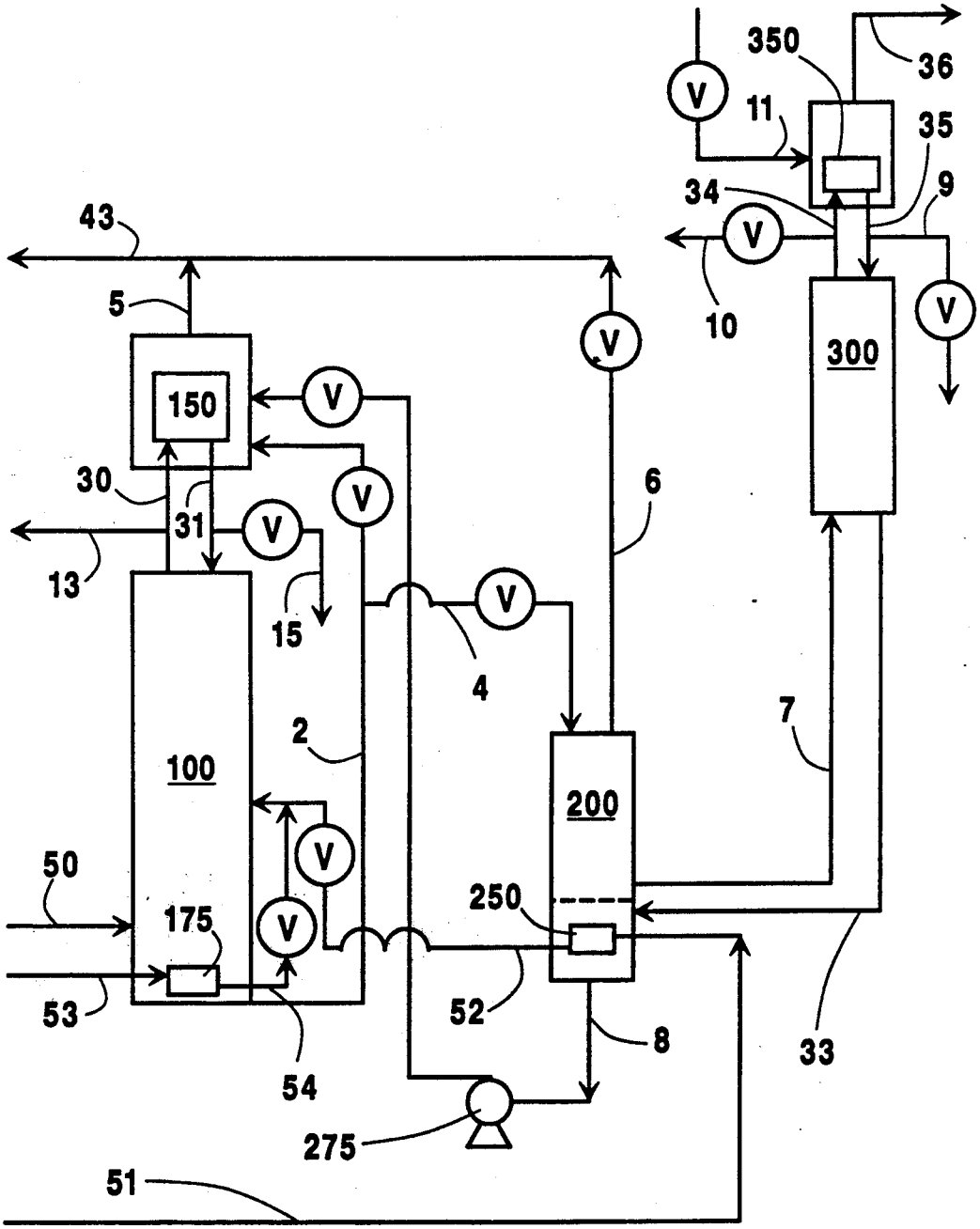
FIG. 4 is a schematic representation of an embodiment of the invention particularly applicable to a hybrid nitrogen production cycle wherein the nitrogen column contains a bottom reboiler.

FIGS. 3 and 4 illustrate embodiments of the invention integrated with air expansion and hybrid nitrogen production cycles respectively. Many of the elements of the embodiments illustrated in FIGS. 3 and 4 correspond to those discussed in detail with respect to the embodiment illustrated in FIG. 1 and thus a detailed discussion of these common or corresponding elements will not be repeated. The elements of FIGS. 3 and 4 which correspond to those of FIG. 1 have the same numerals as appear in FIG. 1.

Referring now to FIG. 3, feed air is divided into two portions. The main portion 40 comprising from about 65 to 95 percent of the feed air is turboexpanded to generate refrigeration and is passed into column 100 which is operating at a pressure within the range of from 40 to 70 psia. Another portion 41 of the feed air, which is at an elevated pressure, is passed through bottom reboiler 250 to reboil the oxygen-richer liquid and the resulting condensed stream 42 is passed into the lower portion of nitrogen column 100. Waste vapor stream 5 from top condenser 150 is not turboexpanded but rather is combined with the vapor outflow 6 from first purifying column 200 and this combined stream 43 is passed out of the system. Ultra high purity oxygen product and nitrogen product are produced in substantially the same manner as was described in detail with reference to FIG. 1.

FIG. 4 illustrates a hybrid single column nitrogen column system having a bottom reboiler as well as a top condenser. Referring now to FIG. 4, three feed air portions are employed. The main portion of the feed air is turboexpanded to generate refrigeration and this portion, comprising from 50 to 90 percent of the feed air, is passed as stream 50 into column 100 which is operating at a pressure within the range of from 40 to 70 psia. Another portion 51 of the feed air is passed through bottom reboiler 250 to reboil oxygen-richer liquid in a manner similar to that described with reference to FIG. 3 with the resulting stream 52 passed into column 100. A third feed air stream 53 is condensed by passage through reboiler 175 thus serving to reboil column 100. Resulting condensed stream 54 is then passed into the lower portion of column 100. Both feed air streams 51 and 53 are at an elevated pressure. This hybrid arrangement enables the production of nitrogen having a higher purity without starving the nitrogen column for reflux or requiring a recycle of purified nitrogen. Waste streams 5 and 6 are handled in a manner similar to that described in reference to FIG. 3. Ultra high purity oxygen product and nitrogen product are produced in substantially the same manner as was described in detail with reference to FIG. 1.

Although both the air expansion embodiment and the hybrid embodiment are illustrated showing the passage of oxygen-enriched liquid from the lower portion of column 100 into both top condenser 150 and into first purifying column 200 as is also shown in FIG. 1, it will be recognized by those skilled in the art that both the air expansion embodiment and the hybrid embodiment may be practiced with the oxygen-enriched liquid from the lower portion of column 100 being passed entirely into top condenser 150 and an oxygen-enriched liquid stream being passed from top condenser 150 to the upper portion of first purifying column 200 as is illustrated in FIG. 2.

Now by the use of this invention one can efficiently produce a small amount of ultra high purity oxygen product while also producing nitrogen product, optionally at an elevated pressure, without disrupting the nitrogen production system. Although the invention has been described in detail with reference to certain embodiments, those skilled in the art will recognize that there are other embodiments of the invention within the spirit and the scope of the claims.

I claim:

1. A method for producing nitrogen and ultra high purity oxygen by cryogenic rectification of feed air comprising:

(A) introducing feed air into a single column system comprising a column and a top condenser and separating the feed air in the single column system by cryogenic rectification into nitrogen-rich vapor and oxygen-enriched liquid having an oxygen concentration not exceeding 80 percent and containing heavier and lighter components;

(B) recovering a first portion of the nitrogen-rich vapor from the column of the single column system as product nitrogen, condensing a second portion of the nitrogen-rich vapor in the top condenser, and employing resulting nitrogen-rich liquid as reflux for said column;

(C) passing oxygen-enriched liquid from the single column system into and down a first purifying column having a bottom reboiler to produce an oxygen-richer fluid in the lower portion of the first purifying column substantially free of lighter components;

(D) passing oxygen-richer liquid from the bottom reboiler of the first purifying column into the top condenser of the single column system to condense by indirect heat exchange nitrogen-rich vapor;

(E) passing oxygen-richer vapor from a point at least one equilibrium stage above the bottom reboiler of the first purifying column into and up a second purifying column to produce ultra high purity oxygen in the upper portion of the second purifying column substantially free of heavier components; and (F) recovering ultra high purity oxygen from the second purifying column.

2. The method of claim 1 wherein the oxygen-enriched liquid is passed from the column of the single column system into the first purifying column.

3. The method of claim 1 wherein the oxygen-enriched liquid is passed from the top condenser of the single column system into the first purifying column.

4. The method of claim 1 wherein the oxygen-richer liquid from the bottom reboiler of the first purifying column is increased in pressure prior to being passed into the top condenser of the single column system.

5. The method of claim 1 wherein the first portion of the nitrogen-rich vapor recovered from the column is condensed and recovered as liquid.

6. An apparatus for producing nitrogen and ultra high purity oxygen by cryogenic rectification comprising:

(A) a single column system comprising a column and a top condenser, means for introducing feed into the column, means for passing fluid from the column to the top condenser and from the top condenser to the column, and means for recovering product from the column;

(B) a first purifying column having a bottom reboiler, means for passing fluid from the single column system into the upper portion of the first purifying column, and means for passing fluid from the bottom reboiler of the first purifying column into the top condenser;

(C) a second purifying column, means for passing fluid from a point at least one equilibrium stage above the bottom reboiler of the first purifying column into the second purifying column; and (D) means for recovering product from the second purifying column.

7. The apparatus of claim 6 wherein the means for passing fluid from the single column system into the upper portion of the first purifying column communicates with the column of the single column system.

8. The apparatus of claim 6 wherein the means for passing fluid from the single column system into the upper portion of the first purifying column communicates with the top condenser of the single column system.

9. The apparatus of claim 6 further comprising pump means on the means for passing fluid from the bottom reboiler of the first purifying column into the top condenser.

10. The apparatus of claim 6 further comprising a bottom reboiler with the single column system.

* * * * *

UNITED STATES PATENT AND TRADEMARK OFFICE

CERTIFICATE OF CORRECTION

PATENT NO. : 5,195,324

DATED : March 23, 1993

INVENTOR(S) : Harry Cheung

It is certified that error appears in the above-identified patent and that said Letters Patent is hereby corrected as shown below:

On the title page, Item [73]:

"Prazair" and insert therefor --Praxair--.

Signed and Sealed this

Twenty-third Day of November, 1993

*Attest:*

*Attesting Officer*

BRUCE LEHMAN

*Commissioner of Patents and Trademarks*